US006810856B2

(12) United States Patent
Magel

(10) Patent No.: US 6,810,856 B2
(45) Date of Patent: Nov. 2, 2004

(54) FUEL INJECTION SYSTEM

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 97 days.

(21) Appl. No.: 10/110,854

(22) PCT Filed: Jul. 27, 2001

(86) PCT No.: PCT/DE01/02845

§ 371 (c)(1),
(2), (4) Date: Aug. 1, 2002

(87) PCT Pub. No.: WO02/14681

PCT Pub. Date: Feb. 21, 2002

(65) Prior Publication Data

US 2003/0029422 A1 Feb. 13, 2003

(30) Foreign Application Priority Data

Aug. 18, 2000 (DE) ..... 100 40 526

(51) Int. Cl.[7] ..... F02M 37/04
(52) U.S. Cl. ..... 123/446; 123/467
(58) Field of Search ..... 123/446, 447, 123/500, 501, 496, 514, 467

(56) References Cited

U.S. PATENT DOCUMENTS 4,271,807 A * 6/1981 Links et al. ..... 123/506
4,381,750 A * 5/1983 Funada ..... 123/446
4,417,557 A * 11/1983 Walter ..... 123/467
4,426,977 A * 1/1984 Taplin et al. ..... 123/446
4,459,959 A * 7/1984 Terada et al. ..... 123/446
4,844,035 A * 7/1989 Takagi ..... 123/446
6,053,421 A 4/2000 Chockley

FOREIGN PATENT DOCUMENTS

DE 199 10 970 A 9/2000
EP 0691471 A1 * 1/1996

* cited by examiner

*Primary Examiner*—Carl S. Miller
(74) *Attorney, Agent, or Firm*—Ronald E. Greigg

(57) ABSTRACT

A fuel injection system has a pressure booster unit (1), disposed between a pressure reservoir chamber and a nozzle chamber, which unit has a displaceable piston unit (4) for boosting the pressure of the fuel to be supplied to the nozzle chamber. For controlling the pressure booster unit (1), the piston unit (4) has a transition from a larger to a smaller piston cross section and a differential chamber (2) formed thereby, which is connected to the pressure reservoir chamber via a filling path (13) having a filling valve (10). A reduction in the control quantity during the triggering of the pressure booster unit (1) and the performance of a rapid restoration of the piston unit (4) are attained.

14 Claims, 2 Drawing Sheets

FUEL INJECTION SYSTEM

CROSS-REFERENCE TO RELATED APPLICATIONS

This application is a 35 U.S.C. 371 application of PCT/DE01/02845, filed Jul. 27, 2001.

BACKGROUND OF THE INVENTION

1. Field of the Invention

The invention relates to a fuel injection system of the type having a displacable piston unit for boosting the pressure of the fuel delivered to the combustion chambers of an internal combustion engine.

2. Description of the Prior Art

For better understanding of the specification and the patent claims, some terms will now be defined: The fuel injection system of the invention can be embodied as either stroke-controlled or pressure-controlled. Within the scope of the invention, the term stroke-controlled fuel injection system is understood to mean that the opening and closing of the injection opening are done with the aid of a displaceable valve member, on the basis of the hydraulic communication of the fuel pressures in a nozzle chamber and in a control chamber. A pressure reduction inside the control chamber causes a stroke of the valve member. Alternatively, the deflection of the valve member can be effected by means of a final control element (actuator). In a pressure-controlled fuel injection system according to the invention, the valve member is moved counter to the action of a closing force (spring) by means of the fuel pressure prevailing in the nozzle chamber of an injector, so that the injection opening is uncovered for an injection of the fuel out of the nozzle chamber into the cylinder. The pressure at which fuel emerges from the nozzle chamber into a cylinder of an internal combustion engine is called the injection pressure, while the term system pressure is understood to mean the pressure at which fuel is kept available or kept in reserve inside the fuel injection system. Fuel metering means furnishing a defined fuel quantity for injection. The term leakage is understood to mean a quantity of fuel that occurs in operation of the fuel injection system (for instance, a reference leakage) but that is not used for injection and is returned to the fuel tank. The pressure level of this leakage can have a standing pressure, and the fuel is then depressurized to the fuel level of the fuel tank.

A stroke-controlled injection has been disclosed for instance by German Patent Disclosure DE 196 19 523 A1. The attainable injection pressure is limited here to approximately 1600 to 1800 bar by the pressure reservoir chamber (rail) and the high-pressure pump.

For increasing the injection pressure, a pressure booster unit is possible, of the kind known for instance from U.S. Pat. No. 5,143,291 or U.S. Pat. No. 5,522,545. The disadvantage of these pressure-boosted systems is the lack of flexibility of injection and poor quantity tolerance when metering small fuel quantities.

A pressure booster unit disposed in the injector is known from European Patent Disclosure EP 0 691 471 A1. A bypass line for a pressure injection and a pressure chamber of the pressure booster unit are connected in series, so that the bypass line is passable only as long as a displaceable piston unit of the pressure booster unit is not in motion and is fully retracted.

SUMMARY OF THE INVENTION

For increasing the injection pressure and the flexibility of the injection, in a common rail injection system, a pressure booster unit is advantageous. To keep the engineering expense and thus the production costs low, controlling the pressure booster unit is done with a simple 2/2-way valve.

A fuel injection system according to the invention is operable to reduce the control quantity during the triggering of the pressure booster unit and for performing a rapid restoration of the piston unit of the pressure booster unit.

By means of the filling valve, an additional filling path is opened up for restoration of the piston unit. The control of the filling valve is effected without an actuator, by means of a pressure difference at the pressure booster unit, in order to keep the engineering expense low.

To achieve a defined pressure difference at the valve body of the filling valve, a throttle restriction can be embodied between the valve body and the guide bore. An additional supply line with a throttle that is preferably kept small serves to initiate the restoration of the piston unit. If the filling valve has a spring and corresponding pressure faces, which can be pressure-actuated by fuel, for switching the filling valve, then the valve body of the filling valve can easily be shifted to the closed position of the filling valve.

BRIEF DESCRIPTION OF THE DRAWINGS

Two exemplary embodiments of the invention are described herein below with reference to the schematic drawings in which.

DESCRIPTION OF THE EXEMPLARY EMBODIMENTS

Figure 1:
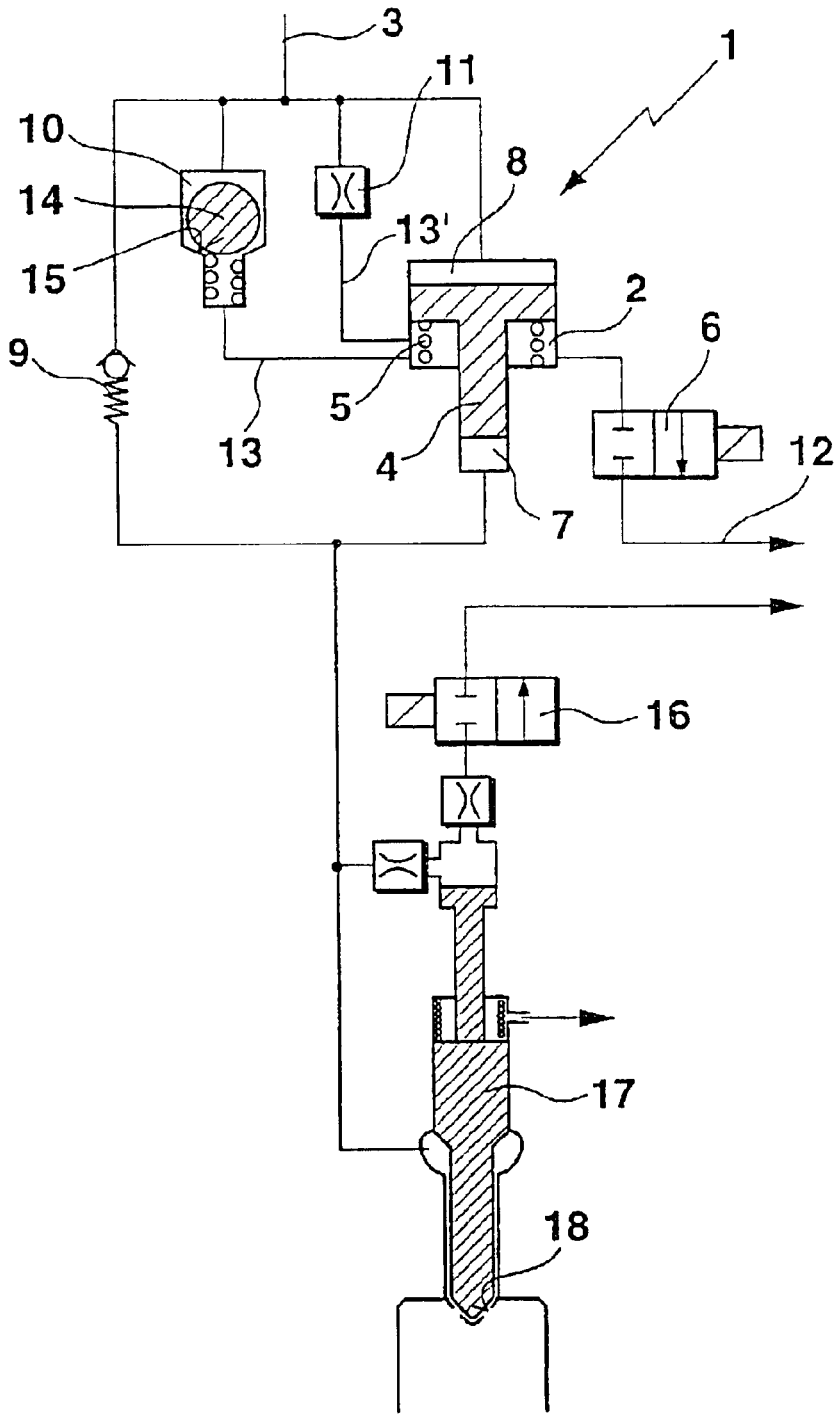
FIG. 1 is a first wiring diagram of the pressure booster unit.

FIG. 1 shows part of a common rail system including a pressure booster unit 1, whose triggering can be seen from FIG. 1, and an injector (a nozzle needle that is displaceable for performing the injection event). For controlling the pressure booster unit 1, the pressure in the differential chamber 2, embodied by a transition from a larger to a smaller piston cross section, is employed. For refilling and deactivating the pressure booster unit 1, the differential chamber 2 is subjected to a supply pressure (rail pressure), in that the pressure booster unit 1 is connected via a supply line 3 to a common pressure reservoir chamber (rail), not shown in FIG. 1, of the common rail system. Then the same pressure ratios (rail pressure) prevail at all the pressure faces of a piston unit 4. The piston unit 4 is pressure-balanced. By means of an additional spring 5, the piston unit 4 is pressed into its outset position. For activating the pressure booster unit 1, the differential chamber 2 is pressure-relieved with the aid of a valve 6, and the pressure booster unit 1 generates a pressure boost in accordance with the surface-area ratio. By means of this type of control, it is possible not to have to pressure-relieve a large primary chamber B in order to restore the pressure booster unit 1 and refill a pressure chamber 7. With a small hydraulic boost, the depressurization losses can thus be reduced sharply. Moreover, in this way a control of the pressure booster unit 1 can be attained by means of a simple 2/2-way valve.

For controlling the pressure booster unit 1, a check valve 9, a filling valve 10 and a throttle 11 are used. The throttle 11 and the filling valve 10 connect the differential chamber 2 to fuel, which is at supply pressure, from the pressure reservoir chamber. The 2/2-way valve 6 connects the differential chamber 2 to a leakage line 12. For activating the pressure booster unit 1, the valve 6 opens. The differential chamber 2 is pressure-relieved via the valve 6. The pressure in the differential chamber 2 drops sharply. While the valve 6 is opened, a lost quantity flows via the throttle 11 into the leakage line 12. The throttle 11 should be designed to be as small as possible. The control quantity during the injection is reduced. The throttle 11 can be integrated with the valve body or the valve seat in the filling path 13. The throttle 11 can equally be integrated with the piston unit 4 or embodied by the gap leakage at the piston guides. Optionally, given a suitable design, it is even possible to dispense with the throttled inlet 13'.

The pressure in the differential chamber 2 is used to control the filling valve 10. If the pressure in the differential chamber 2 drops during the activation of the pressure booster unit 1, the filling valve 10 closes the filling path 13. Thus no leakage quantity can flow into the leakage line via the filling path 13.

For deactivating the pressure booster unit 1, the valve 6 is closed, and a rail pressure builds up in the differential chamber 2 via the throttle 11. The filling valve 10 then opens and opens the filling path 13. The filling of the differential chamber 2 that is required in the restoration of the piston unit 4 can be accomplished quickly and without severe throttling. As a result, only a lesser spring force is required for the restoration. This has major engineering advantages, since in modern engines, given the existing installation space, it is not possible to achieve major spring forces.

The filling valve 10 is embodied such that it closes at a defined pressure difference Δp1 between the valve inlet and the differential chamber 2. For that purpose, the valve body 14 has one pressure face toward the valve inlet and one pressure face toward the differential chamber 2. The valve body 14 is also subjected to an opening spring force. If the pressure in the differential chamber 2 relative to the pressure in the valve inlet drops below the established pressure difference Δp1, then the filling valve 10 closes. If the pressure in the differential chamber 2 rises again after deactivation of the pressure booster unit 1 and reaches the pressure in the valve inlet minus the pressure difference Δp1, then the filling valve 10 opens, and the filling path 13 is opened again.

The result is fast filling of the differential chamber 2. The pressure difference required for switching the filling valve 10 is defined by the spring force and the pressure faces. To achieve a defined pressure difference at the valve body 14, embodied by a ball, there must be a throttle restriction between the valve body 14 and the valve housing. This can be accomplished for instance by limiting the valve stroke or by means of a throttle restriction between the valve body 14 and its guide bore.

If the 2/2-way valves 6 and 16 are closed, then the injector is subject to the pressure of the pressure reservoir chamber 7. The pressure booster unit 1 is located in its outset position. By opening the valve 16, an injection at rail pressure can now be effected, since a nozzle needle 17 can lift from a sealing face 18 as a consequence of the hydraulic pressure ratios at the nozzle needle 17. If an injection at a higher pressure is desired, then the 2/2-way valve 6 is triggered (opened), and a pressure boost is thus attained.

Figure 2:
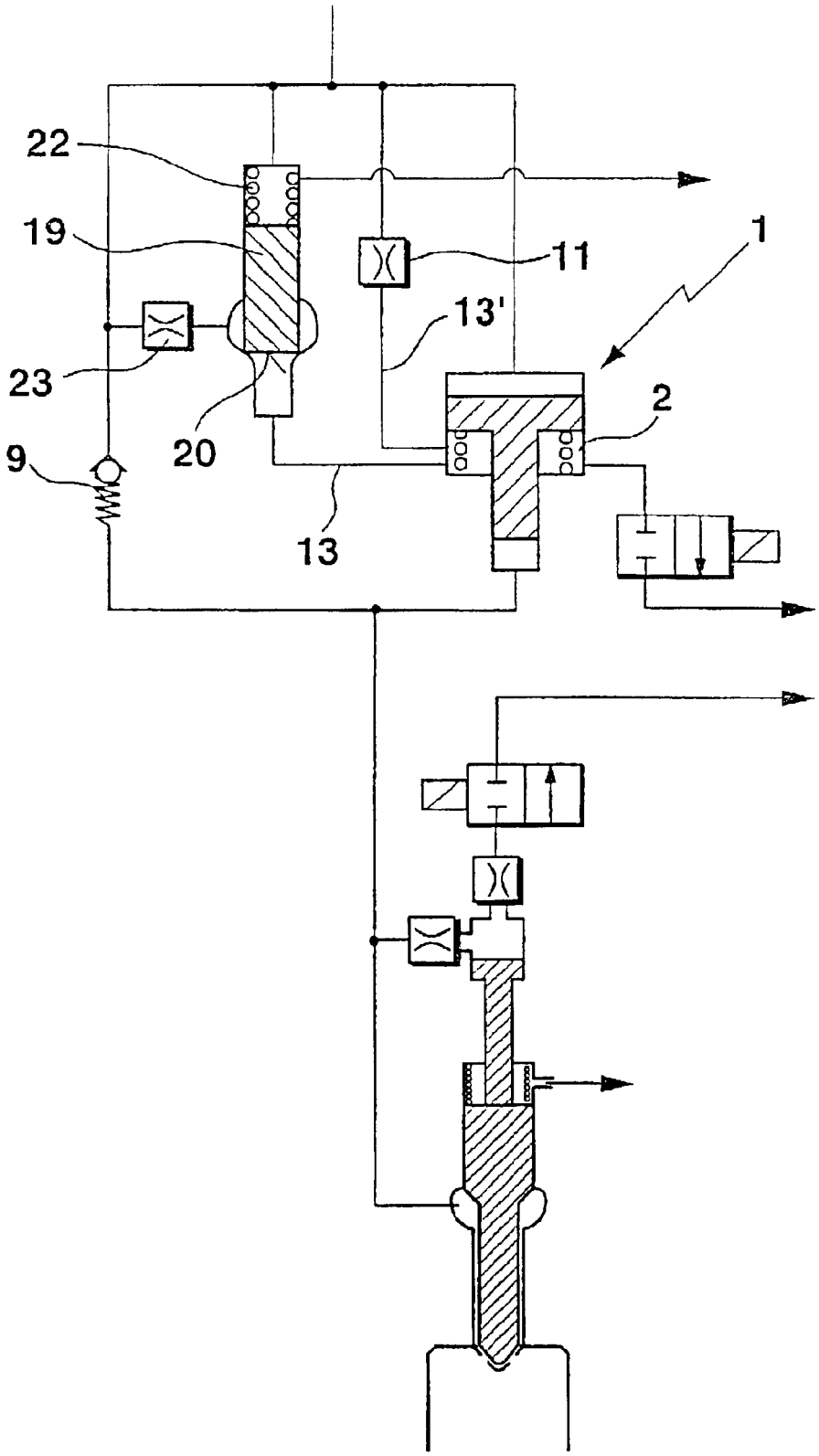
FIG. 2 is a second wiring diagram of the pressure booster unit.

An alternative triggering of the pressure booster unit 1 can be seen from FIG. 2. The inlet to the differential chamber 2 is regulated by the throttle 11 and the filling valve 19. The inlet side (upstream of the sealing seat) of the filling valve 19 is pressure-balanced. A pressure face 20, which is subjected to a pressure prevailing in the differential chamber 2, is located in the region of the sealing seat. If the pressure in the differential chamber 2 drops below the closing pressure, the pressure force on face 20 becomes less than the force of a spring 22, and the filling valve 19 closes the filling path 13. If the pressure in the differential chamber 2 rises above the closing pressure, the pressure force on the pressure face 20 becomes greater than the force of the spring 22, and the filling valve 19 opens the filling path 13.

The foregoing relates to preferred exemplary embodiments of the invention, it being understood that other variants and embodiments are possible within the spirit and scope of the invention, the latter being defined by the appended claims.

I claim:

1. A fuel injection system, having a pressure booster unit (1), disposed between a pressure reservoir chamber and a nozzle chamber, the booster unit having a displaceable piston unit (4) for boosting the pressure of the fuel to be delivered to the nozzle chamber, the improvement wherein the piston unit (4), comprises a transition from a larger to a smaller piston cross section and a differential chamber (2), the differential chamber being formed as a result of the transition and being connected to the pressure reservoir chamber via a filling path (13) having a filling valve (10; 19) for controlling the pressure booster (1), wherein the filling valve (10; 19) is controllable by means of the pressure in the differential chamber (2).

2. The fuel injection system of claim 1 wherein the differential chamber (2) is additionally connected to the pressure reservoir chamber via a supply line (13') with a throttle (11).

3. The fuel injection system of claim 1 wherein the filling valve (19) has a throttle restriction in the sealing seat.

4. The fuel injection system of claim 2 wherein the filling valve (19) has a throttle restriction in the sealing seat.

5. The fuel injection system of claim 1 wherein the filling valve (10; 19) has a spring and corresponding pressure faces, which can be pressure-actuated by fuel, for switching the filling valve (10; 19).

6. The fuel injection system of claim 2 wherein the filling valve (10; 19) has a spring and corresponding pressure faces, which can be pressure-actuated by fuel, for switching the filling valve (10; 19).

7. The fuel injection system of claim 3 wherein the filling valve (10; 19) has a spring and corresponding pressure faces, which can be pressure-actuated by fuel, for switching the filling valve (10; 19).

8. The fuel injection system of claim 1 wherein the filling valve (10; 19) is embodied such that the filling valve (10; 19) is opened when the pressure in the differential chamber (2) is higher than the pressure in the valve inlet, minus a pressure difference Δp1 established in the filling valve (10; 19).

9. The fuel injection system of claim 2 wherein the filling valve (10; 19) is embodied such that the filling valve (10; 19) is opened when the pressure in the differential chamber (2) is higher than the pressure in the valve inlet, minus a pressure difference Δp1 established in the filling valve (10; 19).

10. The fuel injection system of claim 3 wherein the filling valve (10; 19) is embodied such that the filling valve (10; 19) is opened when the pressure in the differential chamber (2) is higher than the pressure in the valve inlet, minus a pressure difference Δp1 established in the filling valve (10; 19).

11. The fuel injection system of claim 5 wherein the filling valve (10; 19) is embodied such that the filling valve (10; 19)

is opened when the pressure in the differential chamber (2) is higher than the pressure in the valve inlet, minus a pressure difference Δp1 established in the filling valve (10; 19).

12. The fuel injection system of claim 8 wherein the filling valve (10; 19) is embodied such that the filling valve (10; 19) is closed when the pressure in the differential chamber (2) is lower than the pressure in the valve inlet, minus a pressure difference Δp1 established in the filling valve (10; 19).

13. The fuel injection system of claim 1 wherein for controlling the pressure booster unit (1), a 2/2-way valve (6) is provided between the differential chamber (2) and a leakage line (12).

14. The fuel injection system of claim 8 wherein for controlling the pressure booster unit (1), a 2/2-way valve (6) is provided between the differential chamber (2) and a leakage line (12).

* * * * *